US005146725A

United States Patent [19]

Bruce et al.

[11] Patent Number: 5,146,725

[45] Date of Patent: Sep. 15, 1992

[54] SPACER MEMBER FOR CONSTRUCTION ELEMENTS

[75] Inventors: Mary L. Bruce, Murrysville; Larell Harris, Pittsburgh; Robert M. McMarlin, Murrysville, all of Pa.

[73] Assignee: Pittsburgh Corning Corporation, Pittsburgh, Pa.

[21] Appl. No.: 706,884

[22] Filed: May 29, 1991

[51] Int. Cl.[5] ..... E04C 1/42

[52] U.S. Cl. ..... 52/308; 52/442

[58] Field of Search ..... 52/307, 308, 477, 273, 52/442, 421

[56] References Cited

U.S. PATENT DOCUMENTS

| | | | |
|---|---|---|---|
| 2,140,997 | 12/1938 | Hohl | 52/477 |
| 4,458,464 | 7/1984 | Borghetto | 52/477 |
| 4,959,937 | 10/1990 | Emil | 52/308 |
| 4,986,048 | 1/1991 | McMarlin | 52/308 |

*Primary Examiner*—David A. Scherbel
*Assistant Examiner*—Creighton Smith
*Attorney, Agent, or Firm*—Reed, Smith, Shaw & McClay

[57] ABSTRACT

A spacer member for maintaining substantially uniform joint spacing between construction elements during construction of a static structure comprising a plurality of construction elements bound to one another by curable matrix material. The spacer member remains embedded in and covered by the matrix material and permits the matrix material to be placed in and completely fill all construction joints between the construction elements in a single application. The spacer member includes structure located interiorly of the planes of the exposed faces of the construction elements for positively establishing and maintaining a desired position of the spacer member during construction of the structure.

28 Claims, 3 Drawing Sheets

SPACER MEMBER FOR CONSTRUCTION ELEMENTS

FIELD OF THE INVENTION

The present invention relates generally to apparatus for maintaining substantially uniform spacing between construction elements during construction of static structures formed by said construction elements, and, more particularly, to spacer members for use in the construction of walls comprising a plurality of wall elements, such as glass bricks or blocks, bound together by curable matrix material.

BACKGROUND OF THE INVENTION

In the past, the placing of wall elements, particularly of glass bricks or blocks, has often entailed positioning of spaced-apart short, narrow wooden strips between adjacent ones of a first layer of wall blocks and, thereafter, positioning spaced-apart short, narrow wooden strips on top of the first layer of blocks to provide uniform spacing between the first layer and a similarly arranged second layer of blocks. In some situations, protruding wooden wedges are also used at different locations in the different layers of blocks to maintain the vertical alignment of the finished wall. Between these wooden strips is placed reinforcing bar, if desired or necessary, for strengthening the wall structure, as well as the mortar matrix for bonding the blocks to one another. After the wall is erected to the preferred dimensions and the mortar has partially hardened, the wooden wedges, if used, are removed completely or the protruding portions are removed, thereby usually causing destruction of the strips. This is because the wooden strips must remain in the block wall construction until the mortar has hardened since, otherwise, the wall would settle unevenly thereby essentially destroying the aesthetics of the wall construction. If the mortar becomes very hard, removal of the wedges becomes quite difficult because of the adherence of the mortar to the wedges. A further disadvantage attendant to the use of removable spacer wedges is that their removal leaves behind spaces at the joints between the blocks which must subsequently be filled by additional mortar.

Further, once the mortar hardens, it is virtually impossible to remove the spaced-apart wooden strips used to position the blocks, and the wooden strips become a part of the finished wall. These permanent horizontal strips or spacers, however, fail to provide any means for assuring accurate spacing between adjacent blocks in a single row.

In U.S. Pat. No. 4,114,337 and its corresponding Canadian counterpart, Canadian Patent No. 1,062,930, there is disclosed a wasted spacer member for wall elements, particularly glass bricks or blocks, wherein the spacer member remains embedded in the mortar of the wall construction upon completion of the wall structure. The spacer member consists of two cross-shaped or T-shaped elements lying in parallel planes and joined by a web. The outermost surfaces of the cross or T-shaped elements are intended to lie in planes spaced inwardly from oppositely directed block faces whereby the cross or T-shaped elements will be covered by mortar upon filling of the spaces or joints between the blocks with mortar. The width of the arms forming the cross or T-shaped elements defines the width of the joints between the blocks and any structure surrounding the blocks.

In a preferred embodiment, the spacer member described in U.S. Pat. No. 4,114,337 also includes either break-off vanes or discs which are attached to and spaced outwardly from the cross or T-shaped elements, such vanes or discs serving to enclose and contact portions of the exposed block faces in order to assist in vertical alignment and guidance of the blocks during placement thereof.

Each of the variously disclosed embodiments of the spacer members described in U.S. Pat. No. 4,114,337 possess features which are detrimental in one form or another to rapid, efficient and aesthetically pleasing erection of a wall construction formed of a plurality of wall elements, particularly glass blocks, bound to one another by matrix material. For example, if the spacer member of U.S. Pat. No. 4,114,337 is not provided with the aforenoted break-off vanes or discs, then it may well be difficult to assure the spacer member will remain in the desired joint position in which it is placed during wall construction. That is to say, unless extreme care is exercised in block placement, the spacer member is likely to become undesirably displaced along the joint during placement of the blocks such that the blocks themselves will also shift thereby requiring the block and spacer placement operations to be repeated. In addition, the shifting of the blocks will almost inevitably result in contact between the blocks which can easily cause damage to certain wall elements such as glass blocks, and the like.

If, on the other hand, the spacer member disclosed in U.S. Pat. No. 4,114,337 is provided with the aforementioned break-off vanes or discs, displacement of the spacer member during block placement may be substantially eliminated. However, the break-off vanes or discs is likely to preclude complete joint filling in a single application. Moreover, the break-off vanes or discs need to be physically removed subsequent to partial hardening of the initially placed mortar If the break-off vanes or discs are not broken off cleanly, i.e., portions thereof either remain projecting from the exposed block faces or cannot be effectively covered by the required subsequent joint filling operation, then a worker must perform additional steps to eliminate the unwanted remaining vane or disc material Such a spacer member construction of U.S. Pat. No. 4,114,337 thus requires a number of additional steps to be performed subsequent to initial joint filling with mortar, namely, breaking off the break-off vanes or discs, removing any remaining unwanted vane or disc material, and subsequent filling of any inaccessible joint area originally covered by the break-off vanes or discs.

Another known device for use in spacing block-like construction elements that are bound together by mortar material, or the like, involves the use of a pair of vanes or discs, each having a plurality of inwardly directed prongs. The vanes are slidably supported on a metallic wire with their respective prongs facing one another. In use, the vanes are placed against the outer block walls and the prongs project into the joint spaces and define spacing means for maintaining the blocks at desired horizontal and/or vertical spacing from one another as the construction elements and the mortar are placed. When the mortar is partially hardened, the vanes or discs are removed and the wire is gripped by pliers and withdrawn. The spaces left by the prongs (and wire) are then filled with additional mortar material. While such a device is adjustable to virtually any block width, it suffers from the disadvantage that the vanes slide freely along the wires.

U.S. Pat. No. 2,227,842 describes generally cross-shaped and T-shaped block anchoring members including a plurality of intersecting arms. The arms are either wavy or are provided with bosses that engage with specially formed glass blocks having either wavy surfaces or recesses formed in the circumferential walls thereof. Although the anchoring members serve the ancillary function of spacing adjacent blocks from one another, their practical application is limited to usage only with customized blocks having the aforementioned circumferential wall configurations. If used in connection with glass blocks of conventional construction, the anchor members, which are not provided with means for preventing unwanted lateral displacement on conventional blocks, will likely become displaced along with the block joints resulting in unwanted shifting of the blocks.

A cross-shaped and a T-shaped spacer member are also known, as in U.S. Pat. No. 4,774,793, which include channels that loosely receive a central circumferential glass block seam that is formed by the joining of two block shells in conventional glass block manufacture. The disadvantage of this spacer member construction is much the same as that associated with other conventional spacer members, i.e., because the channels are substantially wider than the block seam (sometimes as much as several times the width of the seam), the channels do not normally positively engage the seam and thus they are of little use in preventing lateral displacement of the spacer members. Therefore, shifting of the spacer members and the blocks spaced thereby is likely unless extreme care is taken in the placement of the blocks and spacer members.

A need exists, therefore, for spacer members for maintaining substantially uniform joint spacing between construction elements during construction of a static structure comprising a plurality of construction elements bound to one another by matrix material, whereby the spacer member remains embedded in and covered by the matrix material and permits the matrix material to be placed in and substantially fill all construction joints in a single application.

A further need exists for spacer members for maintaining substantially uniform joint spacing between construction elements during construction of a static structure comprising a plurality of construction elements bound to one another by a matrix material, whereby the spacer members include means positioned interiorly of the planes of the exposed faces of the construction elements for positively establishing and maintaining desired positions of the spacer members, and thereby the construction elements, during construction of the static structure.

SUMMARY OF THE INVENTION

In accordance with the present invention, there is provided a spacer member for maintaining substantially uniform joint spacing between construction elements during construction of a static structure comprising a plurality of construction elements bound to one another by curable matrix material. The spacer member remains embedded in and covered by the matrix material and permits the matrix material to be placed in and substantially fill all construction joints between the construction elements in a single application. The spacer member includes means positioned interiorly of the planes of the exposed faces of the construction elements for positively establishing and maintaining a desired position of the spacer member during construction of the structure.

In a preferred application, the static structure is a wall structure formed by a plurality of blocks, particularly glass blocks, bound to one another by mortar, or the like, and the spacer member includes means for engaging formations provided along side walls of the glass blocks to positively establish and maintain a desired position of the spacer member, and thus the blocks engaged thereby, during construction of the wall structure.

The spacer member of the present invention includes two cross-shaped, T-shaped or L-shaped elements lying in parallel planes and joined by connecting means extending transversely thereto The connecting means is of such length that outermost surfaces of the cross, T- or L-shaped elements lie in planes spaced inwardly from oppositely directed exposed faces of the glass blocks. In a most preferred embodiment, the means for engaging formations provided along side walls of the glass blocks include tab members provided on at least two of the arms forming the cross, T- or L-shaped elements and bifurcated receiving members carried by the connecting means. The tab members are adapted to engage raised side edges of the side walls of the blocks and the receiving members are adapted to receive and engage a raised seam or ridge formed substantially centrally along the periphery of the block side walls and extending continuously thereabout in a plane parallel to the exposed opposite faces of the block.

One or more of the arms of the cross- or T-shaped elements are also preferably frangible such that the shape of the elements can be easily changed, if desired, by the installer. Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 1:
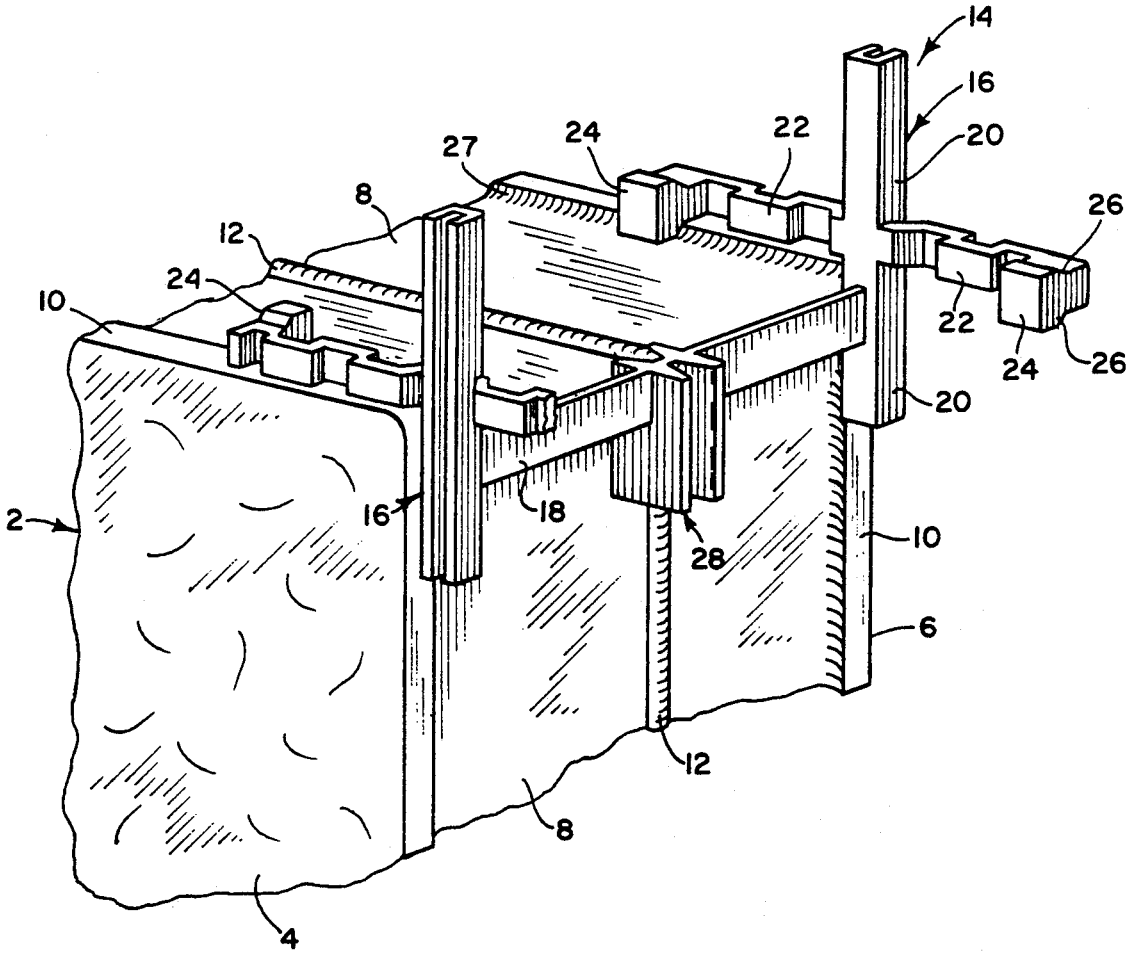
FIG. 1 is a fragmentary perspective view, in partial section, of a preferred embodiment of the spacer member of the present invention shown as it would be placed upon a construction element.
Figure 2:
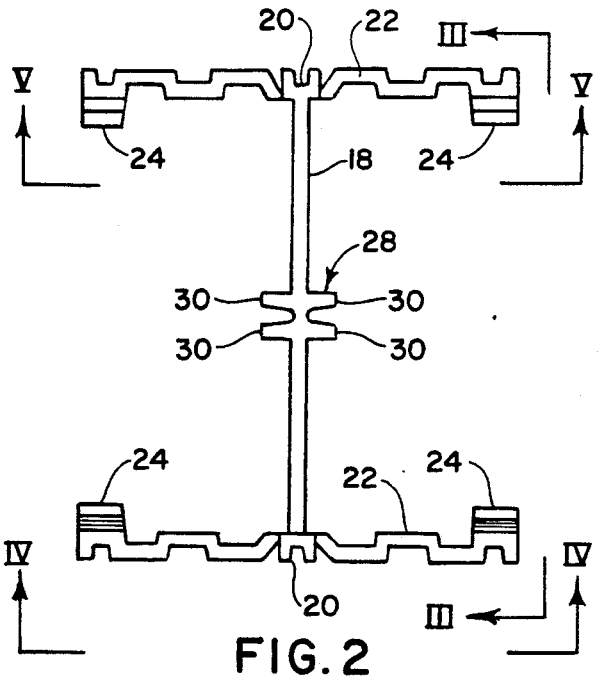
FIG. 2 is a plan view of the spacer member depicted in FIG. 1.

Turning to FIG. 1, there is shown a construction element, herein designated by reference numeral 2, which for description of a most preferred embodiment of the present invention, may be considered to be a standard glass block, or the like. Glass construction blocks such as block 2, as is known, generally include two oppositely directed normally square or rectangular faces 4 and 6 and four side walls 8. The side walls 8 typically are provided with raised formations or edges 10 which extend continuously about the periphery of the block 2. Located substantially centrally along the block side walls 8 is another formation 12 which is a raised seam or ridge that usually extends continuously about the periphery of the side walls of the block in a plane parallel to the opposite faces 4 and 6 of the block. Glass construction blocks such as block 2 are commonly assembled by the fusion, vis a vis, of two substantially identical half-block portions, hence the formation of seam 12 is a normally occurring result of the manufacture of the block. The features of glass block 2 thus far described are provided for purposes of illustration only and they have been included to enable the reader to appreciate a preferred application of a preferred embodiment of the spacer member of the present invention to be described herebelow.

Positioned upon a corner of block 2 is a preferred embodiment of a spacer member 14 constructed in accordance with the present invention. Spacer member 14 may be formed of any suitable material including plastic, metal, wood, or the like, although a plastic material such as polystyrene is preferred because of its relatively high strength and low manufacturing and material costs. As seen in FIGS. 1 through 5, spacer member 14 includes two cross-shaped spacing elements 16 lying in spaced apart parallel planes, which, incidentally, are substantially parallel the planes formed by faces 4 and 6 of block 2. Elements 16 are joined by a connecting means 18 of such length that, when the spacer member 14 is properly positioned, the outer surfaces of elements 16 are spaced inwardly of the planes formed by block faces 4 and 6.

Cross-shaped elements 16 are used to provide horizontal space between adjacent blocks 2 in a particular layer of blocks as well as vertical space between adjacent layers of blocks. Each cross-shaped element 16 includes a first set of oppositely directed arms 20 which preferably rest upon horizontal portions of raised side edges 10 and a second set of oppositely directed arms 22 intersecting and extending perpendicularly to arms 20. In order to insure secure anchoring of the spacer member in the mortar, as shown in the illustrated embodiment, arms 20 assume a channel-like configuration while arms 22 take the form of a corrugated or notched configuration. However, these arm anchoring configurations may be reversed, both configurations may be identical, or the arms may assume entirely different anchoring configurations or be provided with some other anchoring structure such as through-holes, for example, to enhance interlocking of the mortar with the spacer member. In block placement, the blocks are brought into abutment with the arms 20 and/or 22 such that the width of arms 20 and/or 22 defines the outwardly visible width of the joints between the blocks.

As seen in FIGS. 1-5 and 8, the distal ends of arms 22 include inwardly facing tab members 24 having oppositely directed flange portions 26 (FIGS. 1 and 8) which preferably extend to contact block side walls and which substantially matingly receive the interior shoulder regions 27 of the raised side wall edges 10. The tab members 24, along with other structure to be described hereinafter, establish the position of the spacer member 14 and prevent displacement thereof during placement of the construction blocks 2. It will be understood that, if desired, similar inwardly facing tab members may be provided on the distal ends of arms 20, although these tab members would have flange portions that would extend perpendicularly to the direction of the flange portions 26 of the illustrated tab members 24.

Figure 3:
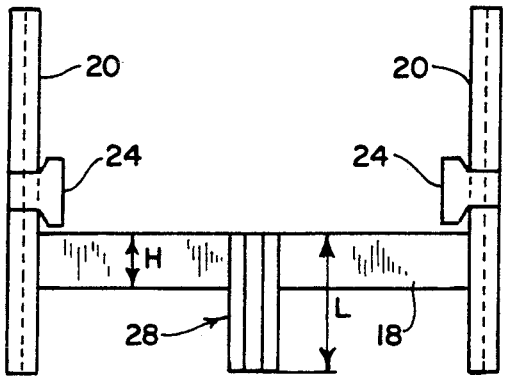
FIG. 3 is a view of the spacer member of the present invention as seen along line III—III of FIG. 2.
Figure 4:
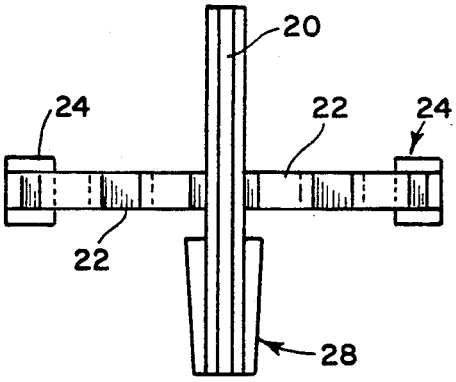
FIG. 4 is a view of the spacer member of the present invention as seen along line IV—IV of FIG. 2.
Figure 5:
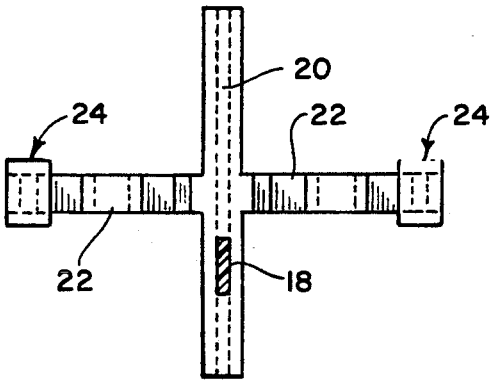
FIG. 5 is a view of the spacer member of the present invention as seen along line V—V of FIG. 2.
Figure 6:
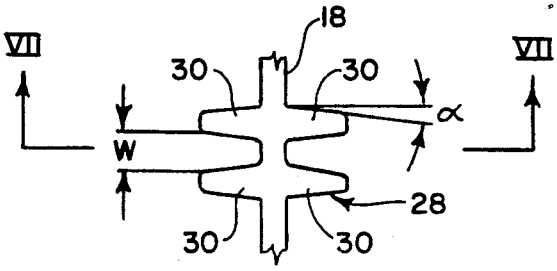
FIG. 6 is an enlarged plan view of a portion of the spacer member of the present invention.
Figure 7:
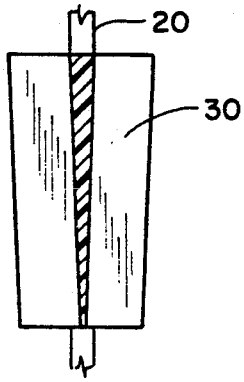
FIG. 7 is a view of the spacer member of the present invention as seen along line VII—VII of FIG. 6.

Carried by connecting means 18 at essentially the midpoint thereof are seam-receiving means 28 which are sized to receive and engage seam 12 of block 2. As seen in FIGS. 1-4, and particularly FIGS. 6 and 7, seam-receiving means 28 preferably consist of two oppositely projecting sets of bifurcated receiving elements each of which include a pair of tapered ribs 30 which have an opening width W (FIG. 6), an angle of taper .a (also FIG. 6) and a depth sufficient to provide a closely engaging fit with the corresponding dimensions of raised seam formation 12. For most conventional glass blocks, a suitable opening width W for ribs 30 would be from about one-tenth to one-fourth of an inch, a suitable angle of taper a would be from about 5° to about 20° and a suitable depth would be about one-eighth to about one-fourth inch. With reference to FIG. 3, it will be seen that the length L of the ribs 30 is preferably substantially greater than the height H of connecting means 18 such that the ribs 30 can positively engage a significant length of seam 12 of block 2 (FIG. 1) and the central seam of an adjacent block (not illustrated) in the same layer as block 2. To achieve this end, it is preferred that rib length L be at least about one-half inch although it can extend to one inch or greater. By virtue of such structure, the desired position of spacer member 14, as well as the blocks engaged thereby, can be positively established and maintained throughout subsequent block placement and joint filling operations. This feature, as noted hereinabove, is still further enhanced if the side walls of glass block 2 are provided with the raised edges 10 and the arms 20 and/or 22 of the spacer member include tab members 24 having flange portions 26 for receiving the raised edges 10. Moreover, although the receiving means 28 preferably assume the configuration of bifurcated receiving elements, as illustrated, it is contemplated that the receiving means may take other suitable shapes or forms to achieve the advantages described herein. For example, the receiving elements of the receiving means may simply comprise two oppositely directed lugs, or similar formations, each having a groove dimensioned to closely receive and positively engage raised seam formation 12.

Figure 9:
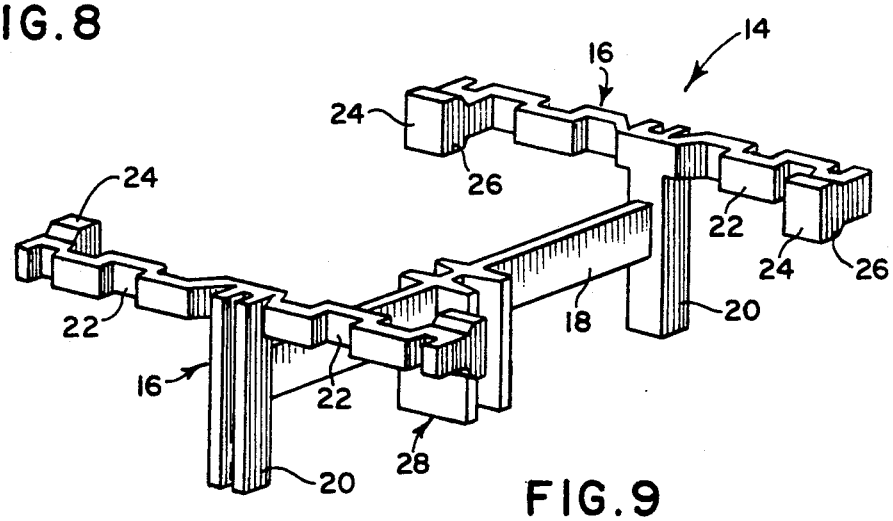
FIG. 9 is a perspective view of a further preferred embodiment of the spacer member of the present invention.

Illustrated in FIG. 9 is another preferred embodiment of the spacer member 14 of the present invention. In this instance spacer member 14 has T-shaped rather than cross-shaped spacing elements. In accordance with this particular embodiment, wherein like references indicate similar elements to those thus far discussed, the only substantial difference between the space member shown in FIG. 9 and the spacer member depicted in FIGS. 1-5 is that one of the arms 20 is eliminated from each of the spacing elements 16 and the upwardly extending flanges 26 of tab members 24 have also been eliminated. This embodiment of the present invention is used, as the reader will appreciate, as a base, top or side edging spacer element of a wall structure formed of construction elements such as block 2.

Figure 10:
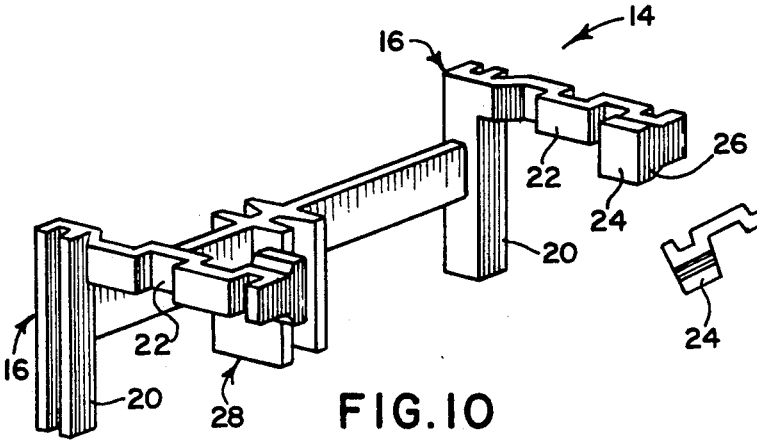
FIG. 10 is a perspective view of a further preferred embodiment of the spacer member of the present invention.

FIG. 10 reveals another preferred embodiment of spacer member 14. According to 'this embodiment, rather than a cross or T-shape, the spacer member 14 has L-shaped spacing elements 16. Thus, for each spacing element, only one of the arms 20 and one of the arms 22 are present. This particular embodiment, as is apparent, is used as a corner spacer element for spacing blocks 2 from a sill, jamb, wall or similar framing structure.

Figure 11:
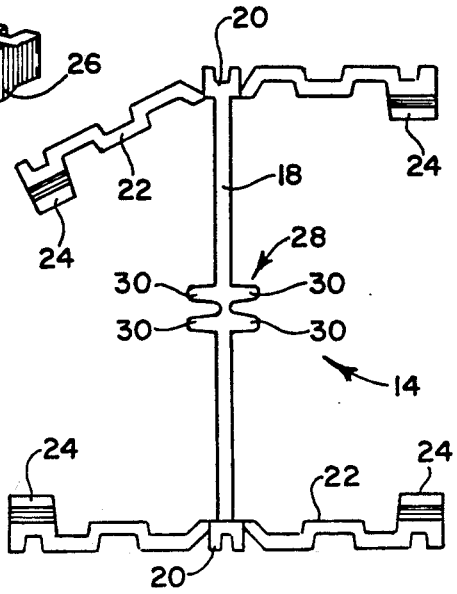
FIG. 11 is a view similar to FIG. 2 depicting how the spacer member of the present invention can be easily and advantageously modified to assume configurations other than its original form.

Turning to FIG. 11, there is shown a further advantage of the spacer member 14. According to the present invention, the arms 22 are frangible and can be easily broken off where they intersect arms 20. Moreover, although not illustrated, the arms 20 which are not joined by connecting means 18 can also be mechanically removed where they intersect arms 22. Thus, a spacer member 14 originally formed as a cross-shaped spacer member can be readily modified to become either a T- or L-shaped spacer member. Likewise, a T-shaped spacer member may be just as easily transformed into an L-shaped member.

Figure 8:
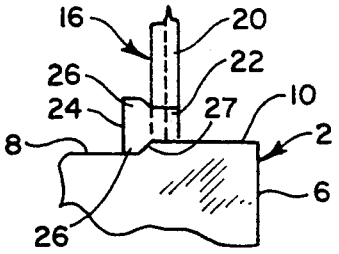
FIG. 8 is an enlarged end elevational view of another portion of the spacer member of the present invention.

Because of the unique construction of the spacer members of the present invention, aside from having structure for preventing translation of the spacer members, the length of the connecting means 18 in all embodiments is such that the outermost surfaces of the spacing elements lie in planes spaced interiorly of the planes formed by the oppositely facing exposed block faces 4 and 6 (FIGS. 1 and 8). In other words, all the structure forming the spacer element 14 lies entirely between the spaced apart planes defined by block end faces 4 and 6. Consequently, unlike when prior art spacer elements are used in wall construction, a worker using mortar to fill the joints between block construction elements spaced by spacer elements 14 of the present invention can substantially fill the joints in a single application as well as substantially cover and embed the spacer elements 14 without requiring any further treatment of the spacer elements or any subsequent filling of gaps left in the joint.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A spacer member for use in spacing adjacent construction elements from one another during construction of a structure comprising a plurality of said construction elements, said construction elements each including oppositely directed face surfaces defining parallel planes and a plurality of side walls having engageable formation structure provided thereon, said formation structure including both a raised seam extending substantially continuously along the periphery of said side walls in a plane located substantially centrally of said parallel planes defined by said oppositely directed face surfaces and first and second raised side edges of said side walls, said first and second raised side edges including interior shoulder regions, said spacer member comprising:

first and second spacing elements lying in spaced apart parallel planes, said spacing elements including means positionable upon at least one of said first and second raised side edges for defining joint spacing between said adjacent construction elements;

means for connecting said first and second spacing elements; and means carried by said spacer member between said spaced apart parallel planes of said first and second spacing elements for engaging said formation structure in order to inhibit displacement of said spacer member and said construction elements during placement of said construction elements, said means for engaging said formation structure including first means for receiving a portion of said raised seam and second means carried by said joint spacing defining means for receiving said interior shoulder regions of said first and second raised side edges.

2. The spacer member of claim 1 wherein said first means for receiving are carried by said connecting means.

3. The spacer member of claim 2 wherein said first means for receiving include at least one set of receiving elements projecting outwardly from said connecting means.

4. The spacer member of claim 3 wherein said receiving elements include a pair of ribs defining an opening therebetween to receive said raised seam.

5. The spacer member of claim 2 wherein said first means for receiving include first and second sets of receiving elements projecting outwardly in opposite directions from said connecting means.

6. The spacer member of claim 5 wherein said first and second sets of receiving elements include pairs of ribs each defining an opening therebetween to receive said raised seam.

7. The spacer member of claim 1 wherein said second means for receiving are carried by said means for defining joint spacing between said adjacent construction elements.

8. The spacer member of claim 7 wherein said second means for receiving include tab members having at least one flange portion for substantially matingly receiving one of said interior shoulder regions of said first and second raised side edges.

9. The spacer member of claim 8 wherein said second means for receiving include tab members having a pair of oppositely directed flange portions for substantially matingly receiving one of said interior shoulder regions of said first and second raised side edges of adjacent ones of said construction elements.

10. The spacer member of claim 1 wherein said connecting means is of a length such that all structure forming said spacer member lies entirely between said spaced apart parallel planes defined by said oppositely directed faces.

11. The spacer member of claim 1 wherein said first and second spacing elements are substantially cross-shaped.

12. The spacer member of claim 1 wherein said first and second spacing elements are substantially T-shaped.

13. The spacer member of claim 1 where said first and second spacing elements are substantially L-shaped.

14. The spacer member of claim 1 wherein said means for defining joint spacing include frangible arm means for enabling ready modification of said spacing elements.

15. A spacer member for use in spacing adjacent construction elements from one another during construction of a structure comprising of plurality of said construction elements, said spacer member comprising:

first and second spacing elements lying in spaced apart parallel planes, said spacing elements including means for defining joint spacing between said adjacent construction elements;

means for connecting said first and second spacing elements; and means carried by said spacer member between said spaced apart parallel planes of said first and second spacing elements for engaging a raised seam and first and second raised side edges provided on said construction elements in order to inhibit displacement of said spacer member and said construction elements during placement of said construction elements, said first and second raised side edges including interior shoulder regions and said spacing elements being positionable upon at least one of said first and second raised side edges, said engaging means including first means for receiving a portion of said raised seam and second means carried by said joint spacing defining means of said spacing elements for receiving said interior shoulder regions of said first and second raised side edges.

16. The spacer member of claim 15 wherein said first means for receiving are carried by said connecting means.

17. The spacer member of claim 16 wherein said first means for receiving include at least one set of receiving elements projecting outwardly from said connecting means.

18. The spacer member of claim 17 wherein said receiving elements include a pair of ribs defining an opening therebetween to receive said raised seam.

19. The spacer member of claim 16 wherein said first means for receiving include first and second sets of receiving elements projecting outwardly in opposite directions from said connecting means.

20. The spacer member of claim 19 wherein said first and second sets of receiving elements include pairs of ribs each defining an opening therebetween to receive said raised seam.

21. The spacer member of claim 15 wherein said second means for receiving are carried by said means for defining joint spacing between said adjacent construction elements.

22. The spacer member of claim 21 wherein said second means for receiving include tab members having at least on flange portion for substantially matingly receiving one of said interior shoulder regions of said first and second raised side edges.

23. The spacer member of claim 22 wherein said second means for receiving include tab members having a pair of oppositely directed flange portions for substantially matingly receiving one said interior shoulder regions of said first and second raised side edges of adjacent ones of said construction elements.

24. The spacer member of claim 15 wherein said connecting means is of a length such that all structure forming said spacer member lies entirely between spaced apart parallel planes defined by oppositely directed faces of said construction elements.

25. The spacer member of claim 15 wherein said first and second spacing elements are substantially cross-shaped.

26. The spacer member of claim 15 wherein said first and second spacing elements are substantially T-shaped.

27. The spacer member of claim 15 wherein said first and second spacing elements are substantially L-shaped.

28. The spacer member of claim 15 wherein said means for defining joint spacing include frangible arm means for enabling ready modification of said spacing elements.

* * * * *